United States Patent [19]

Kahn

[11] Patent Number: 5,075,992

[45] Date of Patent: Dec. 31, 1991

[54] MULTI-COLOR LIQUID DISPLAY SYSTEM

[76] Inventor: Jon B. Kahn, 3002 Stargrass Ct., League City, Tex. 77573

[21] Appl. No.: 663,152

[22] Filed: Mar. 1, 1991

[51] Int. Cl.[5] ..... G09F 19/12

[52] U.S. Cl. ..... 40/406

[58] Field of Search ..... 40/406, 407; 239/17, 239/22, 23; 446/267; 137/154

[56] References Cited

U.S. PATENT DOCUMENTS

| | | | |
|---|---|---|---|
| 751,087 | 2/1904 | Lytton | 40/406 |
| 1,065,435 | 6/1913 | Farr | 137/154 |
| 2,645,048 | 7/1953 | Adams | 40/406 X |

*Primary Examiner*—Kenneth J. Dorner
*Assistant Examiner*—J. Bonifanti
*Attorney, Agent, or Firm*—Marvin J. Marnock

[57] ABSTRACT

A multi-color liquid display system comprising a liquid conduit 14 and a display apparatus operatively associated therewith. A fluid circulating system is connected to the liquid conduit 14 for sequentially circulating different colored liquids 22,24 of different specific gravities through the liquid conduit to produce the visual display either as a writing sign 10 wherein a transparent liquid conduit 14 is illuminated by luminous tubing 12 or as a fountain wherein the liquid conduit is fitted with a nozzle and mounted in a fountain basin to produce a fountain spray. The fluid circulating system includes a reservoir tank 20, a pump 36, a metering chamber 30 above the reservoir and a dispensing chamber 28 below the metering chamber, a plurality of ducts 40,42 and 48, for fluidly communicating the different strata of liquids in the reservoir 20 with the metering chamber 30, and a siphon line 52 and an air breather line 50 interconnecting the metering chamber and dispensing chamber. The open ends of the ducts 40,48, the siphon line 52 and the air breather line 50 in the metering chamber 30 are in a vertical arrangement such that the liquids 22,24 are siphoned from the metering chamber for circulation in sequence through the liquid conduit.

14 Claims, 3 Drawing Sheets

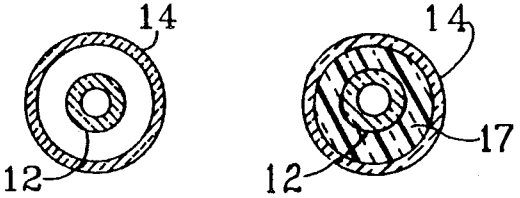
FIG. 2a
FIG 2b
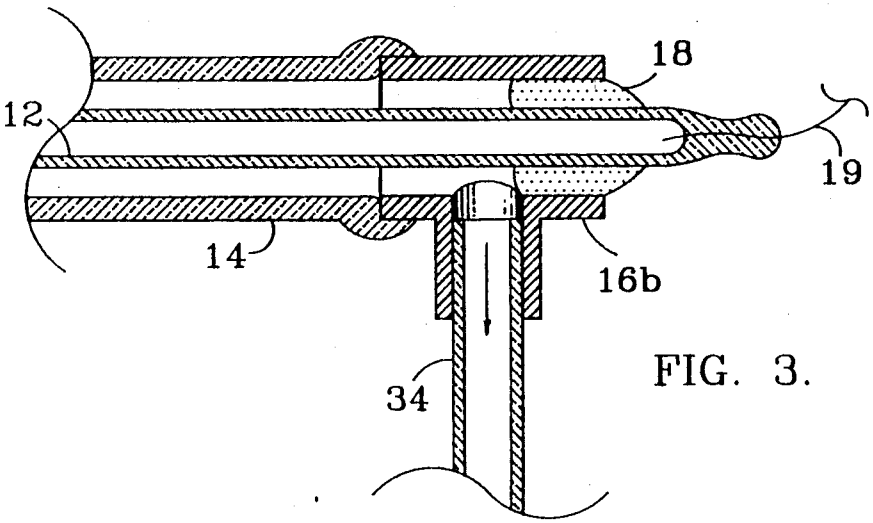
FIG. 3.
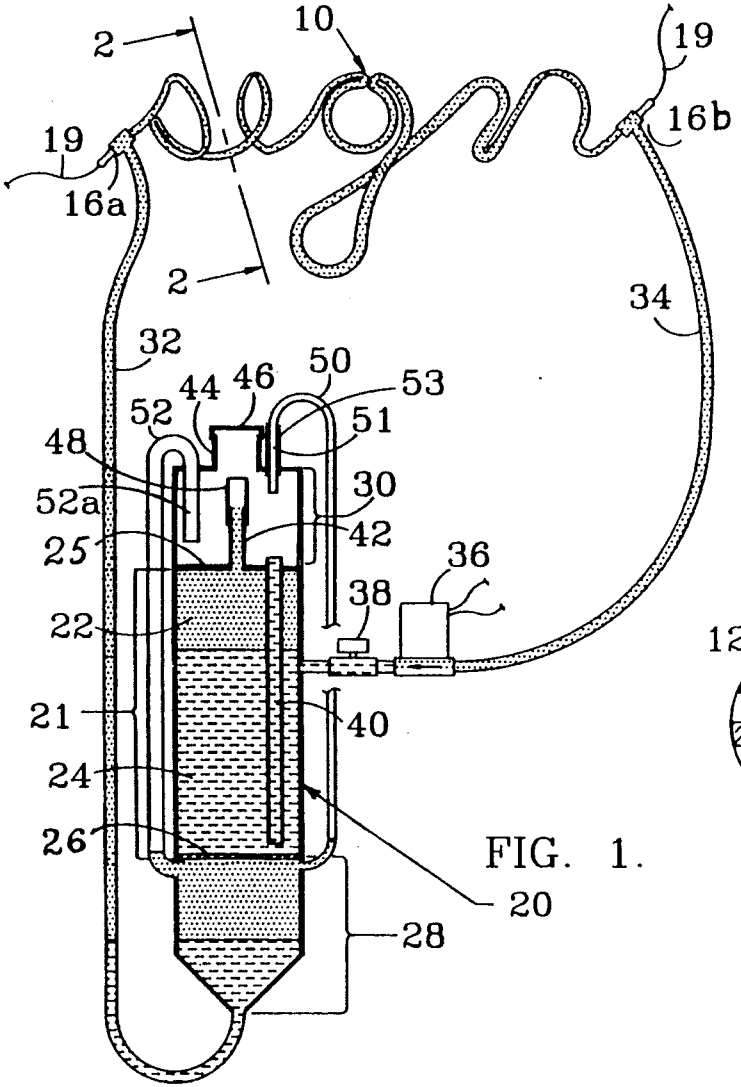
FIG. 1.

MULTI-COLOR LIQUID DISPLAY SYSTEM

FIELD OF THE INVENTION

This invention relates to a display system and more particularly to a display system which includes a display device such as a sign or fountain display which is connected in a fluid circulating system wherein liquids of different colors and specific gravities in the fluid circulating system are adapted to be pumped in sequence therethrough to present a display wherein the color thereof is changed in a controlled sequence.

BACKGROUND OF THE INVENTION

There are a wide variety of display systems and apparatus which rely on the change of color for presenting a dynamic and colorful display. In the art of electric "writing" signs, for example, one common technique has been to use control of the sign's electrical power to "write-out" the sign as it is progressively illuminated from one end to the other. However, a disadvantage associated with this technique is that the sign is only one color, and may be only partially visibly illuminated at any one instant, unless there are multiple components which are separately illuminated.

Another technique is to employ two distinct signs arranged in strategically similar geometry and control their illuminations with respect to one another. The disadvantage of using dual placed signs is the complexity of the geometry involved and the complicated systems for attempting to "write-out" electrically either one of the two separate systems.

There are other systems which make use of different colored or differently illuminated liquids for providing a colorful visual display. For example, there are other devices which comprise an illuminable gas tube with a liquid pipe in overlapping or embracing relationship and a fluid circulating system for alternately flowing liquids of different colors through the liquid pipe. In these devices, the alternation is effected by multiple pumps and/or valves controlled by complex electromechanical mechanisms to effect the alternate flows. In other displays, such as ornamental fountains, light beams of different colors are played on the fountain sprays in different combinations and sequences to provide various ornamentation effects. The controls and lighting systems associated with such fountains are complex and costly and the visual effects of an illuminated spray is not the same as the visual effect provided by a spray where the liquid itself is colored.

SUMMARY OF THE INVENTION

The invention relates to a multi-color liquid display system which comprises a liquid conduit and a display apparatus associated therewith. A fluid circulating system is connected to the liquid conduit for sequentially circulating different colored liquids of different specific gravities through the liquid conduit to produce the visual display either as a writing sign wherein a transparent liquid conduit is illuminated by luminous tubing encased therein or as a fountain wherein the liquid conduit is open ended and fitted with a nozzle and mounted in a basin to produce a colorful fountain spray. The fluid circulating system which connects to the entry end of the liquid conduit and its exit end in the sign display or a fountain drain in the fountain display includes a reservoir tank, a pump connected between the exit end of the liquid conduit and the reservoir, a metering chamber above the reservoir and a dispensing chamber below the metering chamber, a plurality of ducts for fluidly communicating the different strata of liquids in the reservoir with the metering chamber, and a siphon line and an air breather line interconnecting the metering chamber and dispensing chamber. The duct which communicates the stratum of the lightest liquid in the reservoir with the metering chamber extends upwardly in the metering chamber and is provided with an extension for adjusting the height of the end of the duct above the bottom of the metering chamber and therefore the ratio of the amounts of the liquids to be cycled through the liquid conduit. In addition, the open ends of the ducts, the siphon line and the air breather line in the metering chamber are in a vertical arrangement such that the liquids are siphoned from the metering chamber for circulation in sequence through the liquid conduit.

DESCRIPTION OF THE DRAWINGS

FIG. 1 is a plan view of an embodiment of the invention which comprises a sign and an associated fluid circulating system connecting thereto in accordance with the invention, and wherein parts of the circulating system are shown in cross section;

Figure 5:
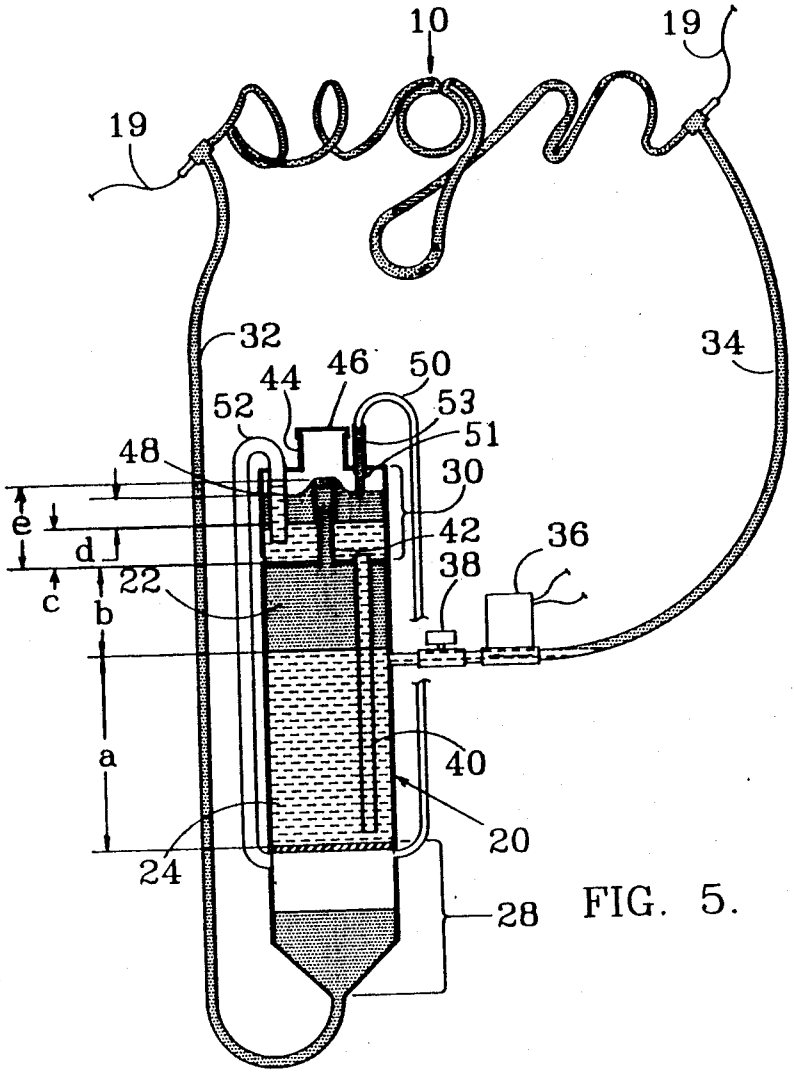
Figure 4:
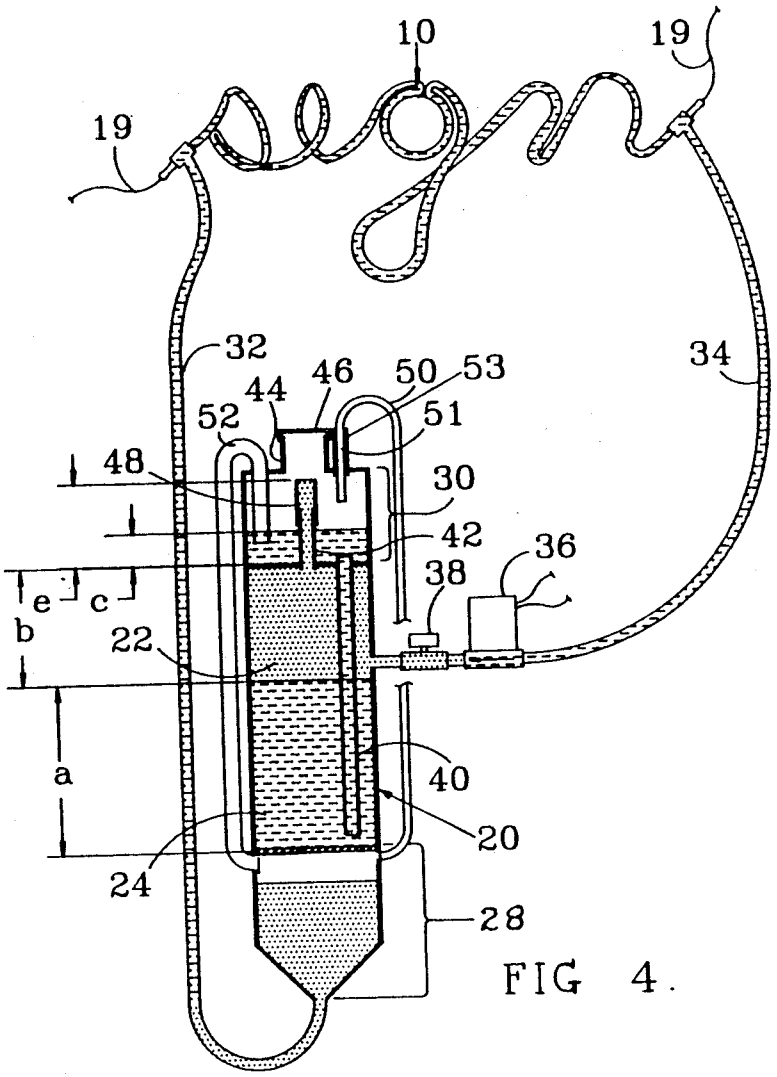
Figure 7:
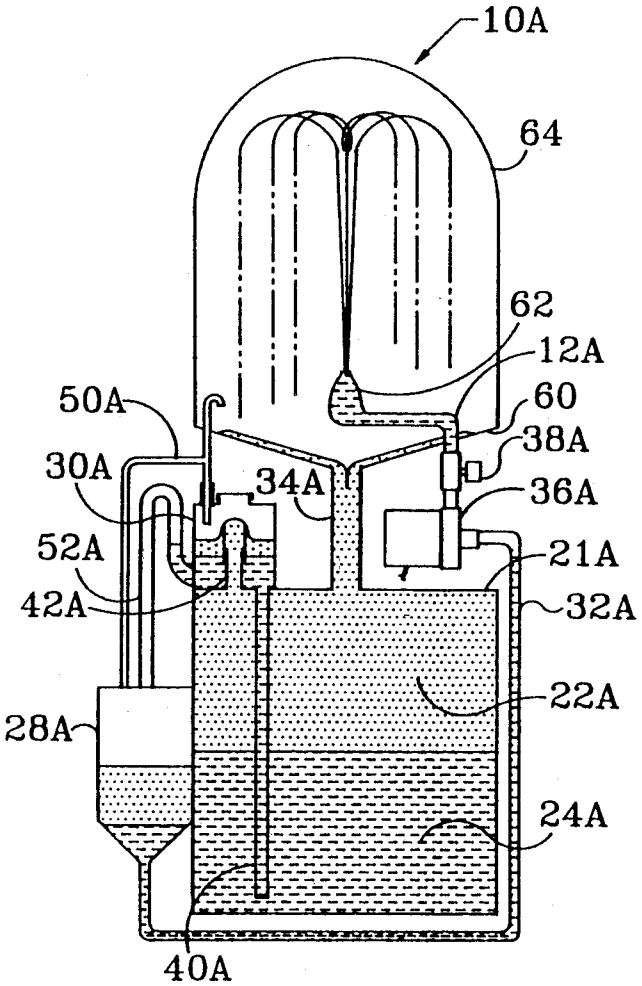
Figure 6:
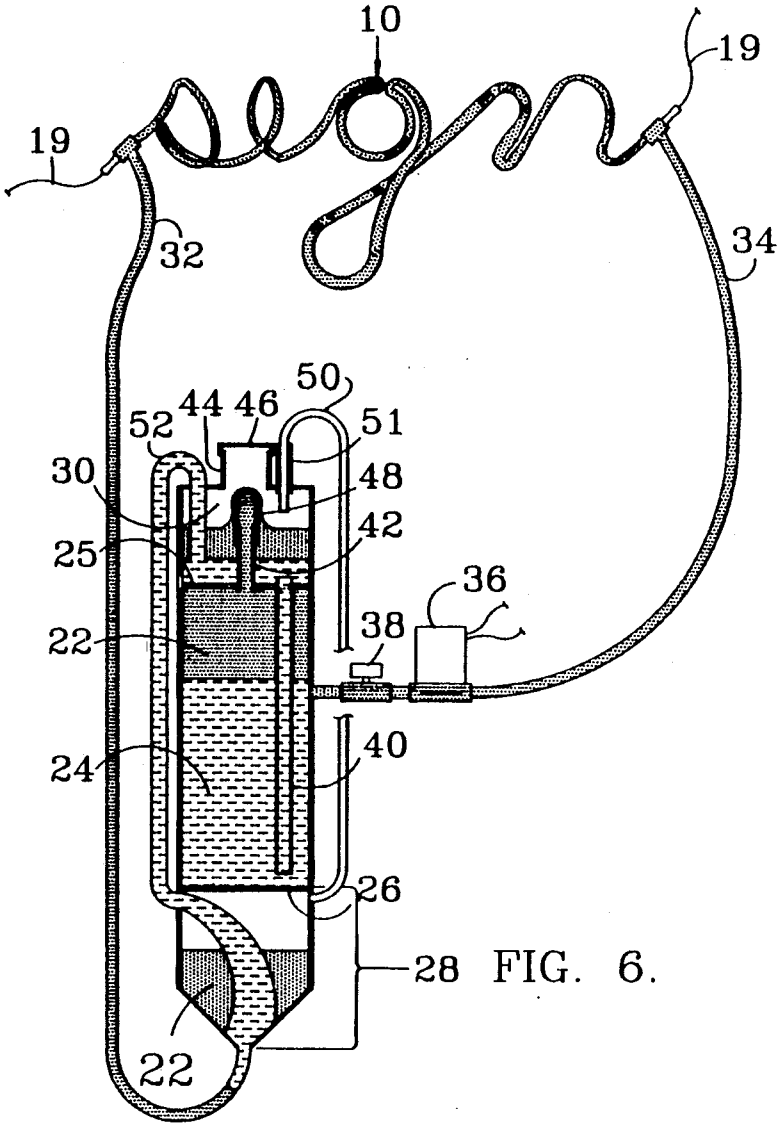

FIG. *2a* is an enlarged radial cross section view through the sign portion of the invention as taken along the section line 2—2 in FIG. 1;

FIG. *2b* is a view similar to FIG. *2a* but showing the sign during a phase of its construction;

FIG. 3 is an enlarged fragmentary section view showing details of construction of the sign portion of the invention, FIG. 4 is a view similar to FIG. 1 showing a disposition of liquids in the fluid circulating system of the invention wherein the heavier liquid has completely displaced the differently colored lighter liquid in the liquid pipe which encases the luminous electric tube in the sign portion of the invention;

FIG. 5 is a view similar to FIG. 4 but showing the distribution of liquids in the fluid circulating system of the invention immediately prior to a siphoning action wherein liquid from a metering chamber is transferred to a dispensing chamber of the fluid circulating system;

FIG. 6 is a view similar to FIG. 5 which shows the distribution of liquids in the fluid circulating system of the invention during a siphoning action wherein liquid is siphoned from the metering chamber to the dispensing chamber of the fluid circulating system; and FIG. 7 is a plan view of a second embodiment of the invention comprising a fountain and an associated fluid circulating system connecting thereto in accordance with the invention, and wherein parts of the circulating system are shown in cross section.

Referring more particularly to the drawings, there is shown in FIG. 1 an embodiment of the invention, which includes a "sign" component 10 in which the word "sign" is depicted in script form and an associated fluid circulating system component operatively associated therewith. The sign component of the invention consists of a typical white light electric gas discharge tube 12 of transparent glass which is encased in a hollow transparent concentric tubing 14 which allows the flow of colored liquids through the annulus defined by the space between the inner tubing 12 and the outer tubing 14 to thereby discriminately filter the white light, causing the sign to appear to be the color of the liquid which is present between the tubings. The fluid circulating system, to be hereinafter described, is connected to the sign 10 by means of an entry conduit line 32 connected to the tubing 14 at one end of the sign and an exit conduit line 34 which connects to the tubing 14 at the other end of the sign.

The construction of the sign 10 and the method of encasing the glass tubing 12 within the hollow, concentric outer tubing 14 is depicted in FIGS. 2 and 3. As a first step, the tubing 12 is coated externally with a temporary material, such as a water-gelatin compound or wax or other material 17, of a thickness corresponding to a thickness associated with the annulus which will form the flow passage between the tubes 12 and 14. The coating may be accomplished by repeated dippings of the glass tubing in a vat of gelatin which has been heated to liquid or paste form so as to form the coating which is allowed to cool and harden thereon. After being heated to a liquid or paste consistency, the water-gelatin compound 17 is applied over substantially the entire length of the tubing 12 except for the end portions. It is then coated in similar fashion or by spraying or the like with a transparent material of a semi-rigid plastic form which later hardens thereon. The water-gelatin compound, which could be a commercially available food gelatin including such components as disodium phosphate, artificial coloring and fumaric and adipic acids, is then removed by an application of relatively low heat, which turns the gelatin or wax into a liquid. This is designed to occur at a temperature which is below that at which the glass tubing 12 and the hard tubing 14 would begin to soften. The tubing 12 is retained concentric with respect to the tubing 14 by means of connecting tees **16*a*, 16*b* fitted at the respective ends of the tubing 14 and an epoxy material 18 which is deposited about the tubing 12 within the bores of the connector tees 16*a*, 16*b* at the outer end of each connector tee whereby the right angular extension of each tee and the annulus between the tubings 12 and 14** are in fluid communication.

The tubing 12 may be made into an electric gas discharge tube, being filled with argon gas and equipped with electrodes 19 at the ends thereof, either before or after the tubing 14 is formed thereabout. The tubing 12 is preferably a typical white light argon sign, although it may be filled with other rarified gases which are rendered luminous by ionization and electric current when placed in an electric field. For most signs, particularly when in script form, the tubing 12 is likely to have a complex geometry and for such forms, the tubing 14 is most appropriately a plastic material, such as a polyester resin which can be applied as a viscous liquid coating and then hardens to rigid permanent form as it reacts with a suitable chemical hardener which is mixed therewith. The temporary material described herein as a gelatin or wax which is used to form the annulus between the tubings 12 and 14 could be some other material which might be removed by chemical action, such as acidic action.

The fluid circulating system component of the invention comprises a liquid tank 20 which may be of elongate circular cylinder form which, for operational purposes, is supported in vertical orientation by any suitable supporting means (not shown). The tank 20, which is made of plexiglass or the like, is provided with internal dividers 25,26 near its respective upper and lower ends which divides the tank into a large central reservoir 21, an upper metering chamber 30 and a lower dispensing chamber 28. In a preferred design, the system may be designed with a capacity of four gallons for the reservoir 21, and capacities of two and three gallons for the metering chamber 30 and dispensing chamber 28, respectively.

A duct 40 is rigidly mounted to the divider 25 in a manner as to be suspended vertically therefrom through almost the entire vertical length of the reservoir 21 with its bottom open end spaced from but closely adjacent the bottom of the reservoir 21 as defined by the divider 26. The duct 40 also extends through an accommodating opening provided in the divider 25. The upper open end of the duct 40 is co-planar with or only slightly raised with respect to the upper surface of the divider 25.

The metering chamber 30 is provided with a tubular neck 44 which extends from the top thereof in coaxial relation therewith. The neck 44 is externally threaded at its upper end portion for accommodating a cap 46 which may be threaded thereon.

A second duct 42 is mounted centrally of the divider 25, extending vertically upward from a central opening in the divider 25 into the metering chamber 30 and thereby establishing fluid communication between the reservoir 21 and the metering chamber 30. The design of the duct 42 is such that the height of the upper end of the duct 42 is approximately half the height of the metering chamber 30. A duct extension 48 is sleeved about the duct 42 in fluid tight sealing relation therewith which may be provided by a snug fit or by one or more o-ring seals (not shown) mounted on the cylindrical exterior of the duct 42. The duct extension 48 is mounted by a friction fit or threading such as to be vertically adjustable on the duct 42 and is of sufficient length that its upper open end can be raised to extend into the neck 44 at the top of the metering chamber 30.

Also attached to the tank 20 is an external air breather conduit line 50 which connects the dispensing chamber 28 in fluid communication with the metering chamber 30. The breather line 50 is connected to open into the chamber 28 near the top of the chamber 28 and just below the divider 26. The breather line 50 extends vertically along the outside of the tank 20 and is curved at its upper end to provide the breather line 50 with a downwardly extending end portion 51 which extends into the chamber 30 through a sealed opening provided in the top of the chamber 30. Preferably, the opening in the top of chamber 30 is fitted with a tubular sleeve 53 rigidly mounted on the top of the metering tank 30 about the opening in the top of the chamber 30 to provide a snug friction fit with the end portion 51 of the air breather line. Accordingly, the height of the open tip of the breather line portion 51 is adjustable by pushing or pulling the end portion 51 in the sleeve 53.

A siphon conduit line 52 is also attached to the tank 20 in a manner which also establishes fluid communication between the dispensing chamber 28 and the metering chamber 30. The siphon line 52 is curved at its upper end and includes a downwardly extending portion **52*a* which extends downwardly into the chamber 30 through an opening provided in the top of the chamber 30. The design is such that the lower open end of the siphon extension 52*a* is below that of the open end of the breather line 51**.

The dispensing chamber 28 is tapered at its lower end providing a frusto-conical configuration in its lower end portion with an opening formed in the bottom thereof. The entry line 32 is connected to the dispensing chamber 28 at its bottom opening and to the connecting tee 16*a* at the opposite end of the sign portion 10 from the connecting tee **16*b* which connects with the exit line 34. An electric pump 36 is connected in the exit line 34 for pumping fluids therethrough when operational. A valve 38 is also installed in the exit line 34 intermediate the pump 36 and the end of the exit line 34 which connects with the tank 20 at a location which opens into the reservoir 21. The valve 38** is an optional component, which may be used as a means for adjusting the flow rate. A filter might also be provided which can further assist in the separation of the different liquids.

The function of the fluid circulating system is to pass a colored liquid through the liquid pipe 14 in the annulus between the pipe 14 and the tubing 12. By using two immiscible liquids of different colors and specific gravities, such as oil and water, the system functions to circulate the different liquids through the sign in alternation, such that as one liquid begins to fill the sign as the other liquid is expelled therefrom, the sign changes its color progressively along its length from one end to the other, thereby simulating the "writing-out" of the sign. The location of the pump 36 after the sign establishes a suction system for drawing the liquids through the sign rather than pushing the liquids therethrough and avoids fluid mixing inside the pump from destroying the contrast of colors in the sign as could occur were it located immediately before the sign.

To prepare the fluid circulating system for operation after construction, a self-priming pump is installed temporarily between the pump 38 and valve 36. The filler cap 46 is removed and the lighter liquid 22, such as "red" oil, in the amount of four gallons is dumped into the central reservoir 21 of the tank 20 through the neck 44 and duct 42. An equal amount of a heavier liquid 24 of different color, such as "blue" water, is then poured into the central reservoir 21 through the neck 44, the metering chamber 30 and the duct 40 to completely fill the reservoir 21 while displacing approximately two gallons of the oil into the metering chamber 30 through the duct 42 in an amount which overflows the metering chamber 30 and delivers some of the oil to the dispensing chamber 28 through the siphon line 52. The temporary pump is then activated to fill the sign and lines 32,34 with oil, and is then removed. As the liquids are poured into the system and into the dispensing chamber 28, the breather line 50 allows air to be forced out of the dispensing chamber 28 and into the metering chamber 30. When the filler cap 46 is replaced and establishes a fluid tight seal with the neck 44, the air breather line 50 allows for the interchange of air between the chambers 28 and 30 as the variations occur in the quantity of liquid which is present in the chambers.

The pump 36 is then placed in operation to pump the liquids from the dispensing chamber 28 through the entry line 32 into the liquid pipe 14 to the exit line 34 and the annulus between the tubing 12 and pipe 14 such that the respective liquids 22 and 24 are distributed in the system as illustrated in FIG. 1.

As the lighter oil is pumped from the dispensing chamber 28 through the sign and returned to the central reservoir 21, it is replaced by water which fills the entry line 32, the sign 10, and exit line 34 in a distribution of liquids as illustrated in FIG. 4. It is shown in FIG. 4 that the liquid levels rise in both ducts 40 and 42 such that water rises through the duct 40 to completely fill the duct 40 and partially fill the metering chamber 30, while simultaneously therewith oil rises in the duct 42 and its extension 48.

As the pumping action continues, the water is withdrawn from the sign 10 and returned to the central reservoir 21 while the entry line 32, sign 10, and exit line 34 become filled with oil in a distribution of liquids as illustrated in FIG. 5. It will also be seen in FIG. 5, that as this occurs, the oil rises in the duct extension 28 and overflows into the metering chamber 30 seeking its own level atop the water 24.

As the surface level of oil in the metering chamber 30 continues to rise and reaches the tip of the air breather line 50, the metering chamber 30 no longer accepts an additional amount of liquids. Since the tip of the siphon line 52 is closely adjacent the bottom of the metering chamber 30 and is open to the surrounding water below the oil which is floating thereabove, the water begins to rise in the portion of the siphon line 52 which extends into the metering chamber.

As the water continues rising in the siphon line to the apex of the curved portion of the siphon line, it is then drawn downward by gravity into the dispensing chamber 28 as illustrated in FIG. 6, thereby initiating a siphoning action through the siphon line 52. The metering chamber 30, therefore, serves as a holding tank for the heavier liquid which is trapped temporarily and delayed in circulation until enough additional liquid is added to start a siphon.

It is a critical feature of the invention that the siphon line 52 is sized, with respect to its diameter and length, such that the siphon flow rate is greater than the flow rate through the sign 10 and exit line 34 as induced by the pump 36. Accordingly, as the siphoning action depletes the liquids in the metering chamber 30, air in the metering chamber will eventually be pulled into the siphon line 52 and thereby terminate the siphon action. The liquids are then distributed in the system in the disposition illustrated in FIG. 1. If the siphon action never terminated, the lighter liquid would be continuously circulated through the sign to the exclusion of the heavier liquid.

It is to be noted that the tip of the air breather line is adjusted to a desired level in the metering chamber to accommodate a predetermined volume of liquids to be cycled. As the level of liquids reaches the air breather line, the metering chamber will no longer accept liquids and the siphon line begins to fill.

It is also to be noted that when the oil is rising in the metering chamber 30 in a distribution of liquids as illustrated in FIG. 5, but where the oil has first reached the tip of the air breather line 50, a balanced relationship exists such that $$\rho\ H_2O\ (a+b+c)+\rho\ \text{oil}(d)=\rho\ H_2O\ (a)+\rho\ \text{oil}\ (b+e) \qquad \text{Eq (1)}$$

where $\rho$ = density of liquid a = height of surface of heavier liquid with respect to the bottom of the reservoir tank 21, b = vertical distance between the liquids interface in the reservoir tank and the top of the reservoir tank 21, c = height of the surface level of the heavier liquid with respect to the floor of the metering chamber 30, d = vertical distance between the open tip of the air siphon conduit 52 in the metering chamber and the interface of liquids in the metering chamber 30, and e=adjustable height of the open top of the duct extension 48 above the floor of the metering chamber 30.

This equation (1) reduces to $$\rho\ H_2O\ (b+c)=\rho\ \text{oil}\ (b+e-d) \qquad \text{Eq (2)}$$

In order to obtain an adjustment of the height e for the duct extension 48 such that there are equal quantities of the two liquids in the metering chamber 30 when the oil first reaches the tip of the air breather line 50, the condition d=c exists. For this condition, Eq (2) becomes $$\rho\ H_2O\ (b+c)=\rho\ \text{oil}\ (b+e-c) \qquad \text{Eq (3)}$$

and $$e = \frac{\rho H_2O}{\rho oil}(b + c) + c - b \qquad \text{Eq (4)}$$

Accordingly, for the condition d=c and e being determined in accordance with Equation (4), the time interval for which oil is present in the sign is equal to the time interval for which water is present in the sign. By lowering the oil duct extension 48, the value of d becomes smaller and the time interval for which oil is present in the sign is increased. If it is desired to shorten the time for oil in the sign, this may be accomplished by raising the oil duct extension 48. The height of the duct extension then determines the ratio of oil to water that will be dispensed to the dispensing chamber and circulated through the sign.

It will therefore be seen that the height of the air breather line in the metering chamber 30 determines the quantity of liquid to be cycled through the sign. The height of the duct extension 48 in the metering chamber 30 determines the ratio of the quantity of oil relative to the quantity of water that will be dispensed and cycled through the sign and therefore the ratio of the time intervals for which these liquids are present in the sign. The magnitudes of the time intervals, however, are a function of the pump flow rate.

It is to be noted that the "writing" sign described herein represents a mechanical simplification of previous "writing" signs. In the fluid circulating system, the only element requiring electrical power is the pump. Also, other than the pump, the system does not require complex electromechanical devices such as timer controlled valves for effecting the sequential flow of liquids through the sign. Because of its relative simplicity, the invention is adaptable to mass production by injection molding techniques and can therefore be manufactured economically. Polyvinyl chloride is a suitable material for the ducts, entry and exit lines, air breather and siphon lines although other materials could be used.

There is shown in FIG. 7, a second embodiment of the invention wherein the fluid circulating system component of the invention is operatively connected in a fountain display apparatus 10A. In the fountain display, the fluid circulating system is similar to the fluid circulating system of the embodiment of the invention illustrated in FIGS. 1 through 6 and its corresponding components are identified by similar reference numbers to which the letter "A" is appended. As shown in FIG. 7, the circulating system includes a reservoir 21A, a metering chamber 30A on the top thereof, and a dispensing chamber 28A mounted below the metering chamber. Ducts 40A and 42A are provided to communicate the strata of a heavier liquid 24A and a lighter liquid 22A from the reservoir 21A to the metering chamber 30A in similar fashion to the ducts 40 and 42 of the apparatus of FIG. 1. A siphon line 52A interconnects the top of the dispensing chamber 28A with the bottom of the metering chamber 30A and an adjustable air breather line 50A interconnects the top of the dispensing chamber 28A and the metering chamber 30A by a friction fit connection therewith.

The fountain display 10A includes a conically shaped basin 60, the apex of which is directed downwardly and provided with an opening to which one end of a drain or exit line 34A is attached. The other end of the drain connects with the top of the reservoir 21A for communicating contents of the basin to the reservoir 21A. An electrical pump 36A and valve 28A are serially connected in a conduit 32A which leads from the bottom of the dispensing chamber 28A to a liquid conduit 14A equipped with a jet spray nozzle 62 at its open end. The conduit 14A is erected vertically and substantially coaxial with the basin 60 and with its nozzle 62 pointing upwardly. As liquid is pumped to the conduit 12A, a liquid jet stream emanates from the nozzle 62 to produce a fallout spray as a colorful visual display which is gravitationally collected in the basin 60 and returned by gravity through the drain 34A to the reservoir 21A.

To avoid liquid losses by evaporation, the basin 60 is provided with a transparent shell or cover 64 which extends as a large canopy over the basin 60 with its open end fitted about the upper periphery of the basin. The cover 64, of plexiglass or the like, is preferably provided with a height for accommodating the full height of the nozzle jet stream although, if desired, it may be low enough such that the jet stream strikes the top of the cover 64 and its fallout runs down the interior wall of the cover.

It is to be understood that aside from the location of the pump 36A and valve 38A in the entry line to the display rather than in the exit line as in the embodiment of FIG. 1, the fluid circulating system and its operation including the siphoning of liquids from the metering chamber to the dispensing chamber is the same as that of the system of FIG. 1. The different colored liquids 24A and 22A are delivered in sequence to the conduit 12A to produce a colorful fountain spray, which changes color as the liquids are delivered.

It is also to e understood that the foregoing description of the invention has been presented for purposes of illustration and explanation and is not intended to limit the invention to the precise form disclosed. For example, the tank 20 may have a different shape than that of a circular cylinder. For compactness, if desired, the siphon line and air breather line might be run inside the walls of the tank 20 and the pump 36 might be a submersible pump located inside the reservoir 21.

In the embodiment of FIG. 1 through FIG. 6, the liquid pipe 14 might be coiled about the tube 12 in encasing relation therewith. Also, the application of the transparent material 14 need not be limited to a round tubing. The illuminable tube 12 of the sign may be encased in a block of this material with a liquid passage formed therein, thus providing a highly protective barrier to the outside environment.

Further, although the functioning of the system has been described with respect to the presence of two different liquids in the fluid circulating system, it should be apparent that the apparatus can be provided with three or more liquids of different specific gravities and color provided that, for each additional liquid, there is an additional duct for accomplishing its transfer from the reservoir 21 to the metering chamber 30. It is to be appreciated therefore, that various materials and structural changes may be made by those skilled in the art without departing from the spirit of the invention.

I claim:

1. A multi-color liquid display system comprising a liquid conduit for receiving and conveying a liquid delivered thereto, said liquid conduit having an inlet end and an exit end;

means operatively associated with said liquid conduit for effecting a visual display of liquid delivered to said liquid conduit;

a fluid circulating system joining the ends of and including said liquid conduit, said circulating system including a reservoir tank, a metering chamber positioned above said reservoir tank, a dispensing chamber positioned below said metering tank, a plurality of immiscible liquids of different specific gravities and different colors disposed in said circulating system including said reservoir tank, said plurality of liquids including portions thereof arranged in strata in said reservoir tank in order of their relative specific gravities;

a first duct communicating the stratum of heaviest liquid in the reservoir tank with the metering chamber;

a second duct fluidly communicating the stratum of lightest liquid in the reservoir tank with the metering chamber;

an entry conduit member connected to the inlet end of said liquid conduit;

means connected in said system for receiving liquids exiting from said liquid conduit;

means for circulating liquids through said fluid circulating system, said means for circulating including a pump installed in one of said entry and receptacle members between said reservoir tank and said liquid conduit;

an air breather conduit fluidly communicating said metering chamber with said dispensing chamber, said air breather conduit having an open end in said metering chamber at a preselected height above the bottom of the metering chamber which determines the amount of liquids to be cycled through said liquid conduit;

a siphon conduit fluidly communicating said metering chamber with said dispensing chamber, said siphon conduit having an open end in said metering chamber at a location closely adjacent the bottom of said metering chamber; and said second duct having a duct extension adjustably mounted thereon for adjusting the open top end of said second duct to a preselected height above the bottom of the metering chamber to control the ratio of the amounts of different specific gravity liquids to be circulated through said liquid conduit.

2. A multi-color liquid display system as set forth in claim 1 wherein said pump is installed in said receptacle conduit member intermediate the exit end of said liquid conduit and said reservoir tank for sustaining liquids through said receptacle conduit member and delivering the sustained liquids to said reservoir tank.

3. A multi-color liquid display system as set forth in claim 1 wherein said pump is installed in said entry conduit member for pumping liquids from said dispensing chamber to said liquid conduit.

4. A multi-color liquid display system as set forth in claim 2 wherein said means operatively associated with said liquid conduit for effecting a visual display comprises a transparent electric luminous tube mounted within said liquid conduit in coaxial concentric relation therewith.

5. A multi-color liquid display system as set forth in claim 3 wherein said means operatively associated with said liquid conduit for effecting a visual display comprises a nozzle means fitted to the exit end of said liquid conduit for directing a jet stream of liquid therefrom;

a fountain basin located above said reservoir tank and metering chamber;

means for mounting said liquid conduit with said nozzle means located substantially centrally with respect to the fountain basin and directed upwardly such that a liquid jet stream emanating therefrom is directed upwardly to produce a fallout spray as a visual display which is gravitationally collected in said fountain basin, said basin having a drain opening in the bottom thereof; and a drain pipe connected at one end to said basin at said drain opening and at its other end to the reservoir tank whereby liquid collected in said fountain basin is delivered by gravity to said reservoir tank.

6. A multi-color liquid display system as set forth in claim 5 further including a transparent cover mounted on said fountain basin about the periphery thereof to avoid evaporation loss of said liquids, said cover having a height sufficient to accommodate the fountain jet stream therein.

7. A multi-color liquid display system comprising a sign structure including an illuminable tube of predetermined geometric configuration;

a transparent pipe for carrying liquid disposed coextensively with said illuminable tube in a substantially encasing relationship therewith;

a fluid circulating system joining the ends of and including said transparent pipe, said circulating system including a reservoir tank, a metering chamber positioned above said reservoir tank, a dispensing chamber below said metering chamber, a plurality of immiscible liquids of different specific gravities and different colors disposed in said circulating system including said reservoir tank, said plurality of liquids including portions thereof arranged in strata in said reservoir tank in order of their relative specific gravities;

a first duct fluidly communicating the strata of heaviest liquid in the reservoir tank with the metering chamber;

a second duct fluidly communicating the stratum of lightest liquid in the reservoir tank with the metering chamber;

means for circulating fluids through said fluid circulating system, said means for circulating including a pump installed in said system intermediate the exit end of said sign and said reservoir tank for suctioning liquids from said sign and delivering to said reservoir tank;

an air breather conduit fluidly communicating said metering chamber with said dispensing chamber, said air breather conduit having an open end in said metering chamber at a preselected height above the bottom of the metering chamber which determines the amount of liquids to be cycled through said sign;

a siphon conduit fluidly communicating said metering chamber with said dispensing chamber, said siphon conduit having an open end in said metering chamber at a location closely adjacent the bottom of said metering chamber; and said second duct having a duct extension adjustably mounted thereon for adjusting the open top end of said second duct to a preselected height above the bottom of the metering chamber to control the ratio of the amounts of different specific gravity liquids to be circulated through the sign.

8. A multi-color liquid display system as set forth in claim 7 wherein said illuminable tube is an electric gas discharge tube.

9. A multi-color liquid display system as set forth in claim 7 wherein said illuminable tube is configured in script form and comprises a white light electric gas discharge tube of transparent glass.

10. A multi-color liquid display system as set forth in claim 7 wherein said metering chamber, reservoir tank, and dispensing chamber are arranged in vertical orientation and said metering chamber serves to temporarily trap and delay circulation of the heavier liquid until additional liquid is conveyed to the metering chamber through said ducts and the action of said pump in an amount to start a siphon action for siphoning liquid from the metering chamber to the dispensing chamber until the depletion of liquids in the metering chamber terminates the siphoning action upon the intake of air into the siphon conduit.

11. A multi-color liquid display system comprising a sign structure including an electric illuminable member of a configuration which simulates script;

a hollow body member of transparent material and similar configuration arranged in an encasing but spaced coaxial concentric relationship coextensive with said illuminable member, the spacing between said illuminable member and said hollow body member defining an annulus for accommodating the flow of liquids therethrough;

a fluid circulating system joining the ends of said pipe whereby liquids may be circulated therethrough, said circulating system comprising:

a liquid reservoir tank, an exit conduit connecting the discharge end of said pipe in fluid communication with said reservoir tank, a metering chamber located above said reservoir, a first duct connected to the bottom of said metering chamber with its bottom end closely adjacent the bottom of said reservoir and its upper end opening into said metering chamber at the bottom thereof, a second duct establishing fluid communication between said reservoir and metering chamber, said second duct extending upwardly into said metering chamber with its bottom end opening at the top of said reservoir, a duct extension adjustably mounted on said duct whereby the height of the top end of said second duct with respect to the bottom of said metering chamber may be readily adjusted, a dispensing chamber located below said metering chamber, a siphon conduit connected at its lower end to said dispensing chamber and interconnecting said metering chamber and dispensing chambers in fluid communication, said siphon conduit having an upper end portion which extends downwardly into said metering chamber with its lower end closely adjacent the bottom of said metering chamber;

an air breather conduit connected at its lower end to said dispensing chamber near the top thereof and interconnecting said metering chamber and said dispensing chamber in fluid communication, said air breather conduit having an upper end portion which extends downwardly into said metering chamber with its lower end a predetermined adjustable height above the bottom of said metering chamber;

a pair of immiscible liquids of different specific gravities and different color disposed in said fluid circulating system; and pumping means installed in said exit conduit for continuously pumping liquid from said sign structure into said reservoir tank.

12. A multi-color liquid display system as set forth in claim 11 wherein the illuminable member of such sign structure is an electric gas discharge tube filled with argon gas.

13. A multi-color liquid display system as set forth in claim 11 wherein said siphon conduit is sized as to its diameter and length such that the siphon rate is greater than the flow rate through said pumping means.

14. A multi-color liquid display system as set forth in claim 11 wherein said hollow body member is a tubular pipe.

* * * * *